United States Patent [19]

Gerstenberger et al.

[11] 4,369,759

[45] Jan. 25, 1983

[54] RECOILLESS AIR WEAPON

[75] Inventors: Friedrich Gerstenberger, Dürnau; Ludwig Jaedicke, Ulm, both of Fed. Rep. of Germany

[73] Assignee: Anschutz GmbH, Ulm, Fed. Rep. of Germany

[21] Appl. No.: 185,554

[22] Filed: Sep. 9, 1980

[30] Foreign Application Priority Data

Sep. 12, 1979 [DE] Fed. Rep. of Germany ..... 2936883

[51] Int. Cl.[2] ..... F41b 11/00; F41f 19/00; F41f 19/06

[52] U.S. Cl. ..... 124/68; 89/198; 188/80; 188/83

[58] Field of Search ..... 124/68; 42/1 V; 89/1.7, 89/1.701, 1.702, 1.703, 44 R, 177, 178, 198; 188/67, 80, 83, 166, 343; 267/136, 137

[56] References Cited

U.S. PATENT DOCUMENTS

| | | | |
|---|---|---|---|
| 1,875,391 | 9/1932 | Parker | 188/343 X |
| 3,568,565 | 3/1971 | Swiekowski | 89/198 |

FOREIGN PATENT DOCUMENTS

| | | | |
|---|---|---|---|
| 2329425 | 1/1975 | Fed. Rep. of Germany | 124/68 |
| 2452203 | 5/1975 | Fed. Rep. of Germany | 188/166 |
| 1073648 | 3/1954 | France | 89/198 |
| 1409335 | 10/1975 | United Kingdom | 188/343 |

*Primary Examiner*—Richard T. Stouffer

*Attorney, Agent, or Firm*—Holman & Stern

[57] ABSTRACT

In a sporting air gun in the nature of a recoilless pressurized-air weapon, having a recoilable system which is translatably mounted so as to slide forward and backward on the gunstock of the weapon in a direction which is generally longitudinal. The recoil system compensates by opposed motion the impulse from the firing of the weapon arising from the impulse of each projectile, from the propellant gas, and from individual components which are accelerated for the purpose of the firing. The system minimally comprises a breech casing to which a barrel, a firing mechanism, other functional parts of the weapon, or added masses may be attached to increase the weight of the system. The system has a center of mass lying off the line of action of the impulse resulting from the firing, whereby a torsional impulse is superposed on the firing-resultant impulse. The improvement in the air gun includes at least one torsional impulse generator which is positioned in or on the weapon. This generator forms an autonomous functioning unit with other parts of the weapon, whereby the torsional impulse resulting from the generator is simultaneous with and directed opposite to the torsional impulse which is induced by the recoil system in the firing phase of operation, whereby the torsional impulse from the generator acts substantially in the same plane as or substantially in a parallel plane to the torsional impulse from the recoilable system.

6 Claims, 7 Drawing Figures

RECOILLESS AIR WEAPON

SUMMARY OF THE INVENTION

This invention relates to a sporting air gun, particularly a recoilless pressurized air weapon or small air gun, having a recoil or "recoilable" system which is translatably mounted so as to slide forward and backward on the stock or grip of the weapon in a direction which is generally longitudinal, and which recoil system compensates for the impulse from the firing of the weapon. The impulse arises from the firing force of each projectile, from the propellant gas, and from individual components (e.g., compression pistons, firing pins, or springs) which are accelerated by the firing. This recoil compensation is achieved by opposed motion. The recoilable system comprises basically a breech casing to which a barrel, a firing mechanism, other functional parts of the weapon, or added weight adjustment masses may be attached. The system has a center of mass lying off the vector of the impulse resulting from the firing, whereby a torsional impulse is superposed on the firing force impulse.

Given these basic design conditions, the stock or grip is to be regarded as being the totality of all joined parts which form a relatively fixed aggregate with respect to the recoil system. In addition to the basic stock or grip pieces, there may also be included in this aggregate a case or support mounting, bushings, bearings, or guidebars for the recoilable system, as well as other hardware, and in certain variants there may be further included the barrel and parts of the firing (e.g., trigger) mechanism.

The recoil system is translatable back and forth on the stock or grip, just as is the case with an artillery gun carriage, and is supported so as to minimize the friction of its movement. The direction of its movement coincides with that of the recoil force and the firing force vector. Accordingly, the impulses resulting from firing the individual projectiles, from the propellant gas, or from individual parts of the system which are accelerated by the firing either are not transmitted to the stock, or are transmitted in delayed fashion. The frictional force arising from the relative motion of the recoilable system is compensated, if necessary, in known fashion by a compensating force acting in the opposite direction to it.

BACKGROUND OF THE INVENTION

Classified as to origin, there are two different types of impulses arising in air guns and firearms. The first, or "open system" involves those impulses which arise solely from dynamic interactions between the weapon and masses which are irretrievably separated from the weapon in firing and are made independent of it. These masses are the projectile and, in firearms, the powder gas driving it, or, in air weapons, the compressed air. Even translatable mounting of the recoil system can only suppress the impulses for the duration of the backward motion of the recoilable system, since when the system impinges on the buffer or detent which limits the backward motion, it makes itself felt again via the impact. By this time, however, the projectile has long since left the barrel, so that it is no longer susceptible to being deflected by the impact or vibration caused by the stopping of the recoil system.

The second, or "closed system" type of impulse in firearms involves impulses due to dynamic interactions of component parts on the occasion of the firing, but without those component parts separating themselves from or becoming independent of the unit of combined parts. In contrast to a massive, relatively sluggish aggregate of components, a few components which are light, moveable, and driven by forces of the system itself can execute a quickly starting movement cycle which is previously specified. Such moved component parts are, for example, in firearms, the firing pin, and in weapons powered by compressed air, the compression pistons with their respective drive springs. The impulses produced during the action of these components are equal and opposite, thus cancelling each other when the moved parts come to a stop. Thus, the impulse of the firing pin is nullified when the firing pin impacts against the bottom of the cartridge. Likewise, the forward impulse, in the firing direction, of the flung compression piston of a compressed-air weapon and the impulse of its compression spring along with that of the backward-moving recoil system neutralizes itself when the piston impacts against the head of the compression cylinder and comes to a stop.

In compressed-air-powered weapons the impulse of the compression piston and the compression spring is substantially greater than that of the comparatively low-mass projectile and the air driving the projectile. This suggests according to the law of reaction, that the associated oppositely directed impulse of the recoil system is little greater in magnitude than that of the piston and the compression spring combined. Thus, the backward motion of the recoil system lasts in practice exactly as long as the forward motion of the compression piston, assuming that the system has adequate free space to move.

In contrast, for hand firearms, the impulse of the projectile and the powder gas makes up a very high fraction of the total impulse acting on the recoil system. Only a small fraction is attributable to the firing pin and its spring. This is explainable by the higher weight of the projectile and the much higher projectile velocity, on the one hand, and the very low weight of the firing pin compared to the compression cylinder of a compressed-air-powered weapon, on the other.

In the theory of dynamics, the impulse I of a body or its momentum is defined as the product of its mass m and its velocity v:

$$I = m.v \tag{1}$$

The momentum of a body is changed by the action of an external force F on it for a time interval $\Delta t$. This dynamic property is expressed in the so-called impulse equation: the impulse (of the force) equals the change in the momentum, or, in mathematical notation $$\int_{t_A}^{t_E} F\,dt = \int_{v_A}^{v_E} m\,dv = m \cdot v_{Final} - m \cdot v_{Starting} = m \cdot \Delta v \tag{2}$$

It should be noted that the impulses, forces and velocities entering into this equation are vector quantities, having direction.

From this it can be deduced that for two dynamically interacting bodies the masses are inversely related to the velocity changes and the resultant paths. (Here friction and any deformation are disregarded.)

$$m_1 : m_2 = \Delta v_2 : \Delta v_1 = \Delta s_2 : \Delta s_1 \tag{3}$$

This theoretical relation is used for calculating the backward movement distance needed for a system in a weapon, which system is translated upon firing the weapon.

In the above discussion, it was assumed that the line of application of a given impulse from a force passes through the center of mass of the body acted upon. However, this is often not the case in reality with component parts of recoilless weapons, which parts are moved and are subject to being acted upon by forces. At best, this assumption is valid for compression pistons and compression springs in recoilless compressed-air-powered weapons. On the other hand, many firing pins of firearms are asymmetrically shaped, and accordingly are asymmetrically acted on by their springs. The separation of the center of mass from the line of action of the force-impulse is especially pronounced in translatably mounted recoil systems in recoilless weapons.

Nearly always in these systems the firing mechanism and the cocking mechanism or breech handle (i.e., bolt knob) are integrated and either are attached outside to the breech casing or they project outward. These eccentrically disposed working parts increase the mass of the recoil system and thereby decrease its backward motion upon firing, which is entirely desirable. Additionally, they are constantly directly connected to the other working parts of the weapon which are inside the breech casing. This simplifies the overall design and as a rule also provides operating advantages.

In the ideal case, the common line of action of the impulses generated in the firing should pass through the center of mass of the recoil system. However, as a result of the above-mentioned asymmetric disposition of parts of the system with respect to the line of action of the impulse this is not achievable. This gives rise to the major disadvantage that the resultant impulse of the projectile and the propellant means acts on the recoil system at a distance "r" from the center of the mass, and hence a torsional impulse is superimposed on the impulse. During the firing phase, this torsional impulse leads to a turning of the system and thus of the entire weapon, around a transverse axis passing through its center of mass and running in a plane which contains the direction of fire and which is approximately horizontal in the normal use position, whereby said transverse axis is perpendicular to the longitudinal axis of the weapon. This of course has detrimental effects on the exit of the projectile, particularly in view of the fact that the shooter does not always hold the weapon in place with the same force. The consequence is a larger dispersion radius of the grouping (i.e., larger distribution pattern). Thus, with known recoilless small arms which are nonetheless not free of torsional impulses, it is fundamentally impossible to achieve significant reduction in the size of the dispersion pattern by means of a more precise setting of the weapon parts.

Because of this there is need to avoid the occurrence of a torsional impulse in firing, or to keep it from having an effect. This can be achieved by relatively simple means, if one establishes masssymmetry in the translatable recoil system, and dynamically balances the system. In the process, however, it will be necessary to increase the overall weight of the weapon to some extent. This presents major difficulties in the case of sporting arms because such weapons have a prescribed weight limit by regulation which is usually already reached without the employment of these proposed dynamic balance measures. Of course, independently of this consideration, it is desirable for small arms to be as light as possible.

The problem underlying the invention is, in small arms of the type described at the beginning of the above discussion, at least substantially to compensate the torsional impulse originating in firing, without making use of additional weights which would establish symmetry of mass in the recoil system.

DETAILED DESCRIPTION OF THE INVENTION

Figure 1:
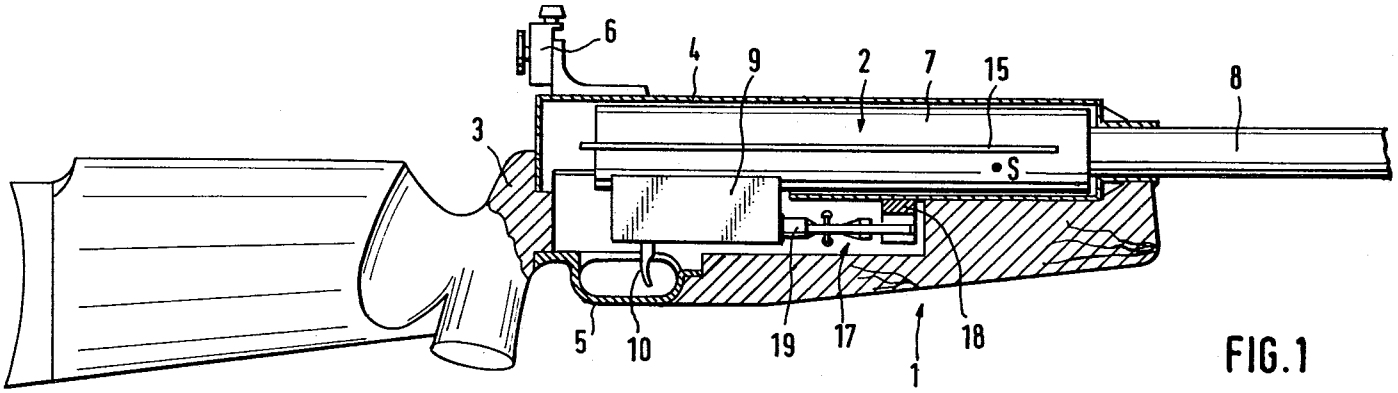
FIG. 1 shows a recoilless pressurized air powered rifle with a torsional impulse generator; the view is a side view; with partial cutaway.

The problem discussed above is solved according to this invention by positioning in the weapon one or more generators of torsional impulses, which generators form closed operating cycles (i.e., autonomous functioning units) with other parts of the weapon, whereby the torsional impulses resulting from said generators is simultaneous with and directed oppositely to the torsional impulse which is induced by the recoil system in the firing phase, and whereby said torsional impulse from the generators acts nearly or exactly in the same plane, or in a parallel plane, to said torsional impulse from the recoil system.

The magnitude of the resultant torsional impulse from said generators (which impulse may be represented by a vector) should be as nearly as possible the same as that of the torsional impulse induced by the recoil system. Under these conditions, the two torsional impulses balance each other out, and the weapon suffers no vibration, shock, or deflection during the firing phase. It should be appreciated that the resultant magnitude of the torsional impulse induced by the recoil system is a mathematical function of time. This means that during the firing phase, it does not stay constant but, rather, it varies. Its basic course may be described as follows: Upon firing the weapon, the magnitude of the impulse rises very rapidly to a maximum, remains constant for a short time, and then falls off relatively slowly, and may finally reverse direction and assume a negative value. This reversal ordinarily does not occur with conventional firearms but does occur in compressed air powered weapons with spring driven compression pistons.

The source of this change in direction of the torsional impulse lies in the steep pressure rise of the air enclosed in the compression cylinder at the end of the piston movement shortly before the piston arrives at the cylinder head. The forces of the gas on the compression piston and the cylinder head, which forces result from the pressure, not only retard the motion of the compression piston but also sharply retard the backward motion of the recoil system. The retardation of the system acts analogously to the reaction phenomenon accompanying the acceleration at the beginning of the firing phase, producing a second, subsequent, torsional impulse with opposite vector to that of the initial torsional impulse.

In order also to compensate the second (reversed) torsional impulse of the recoil system with the torsional impulse generator, the generator must synchronously produce a second torsional impulse with changed sign (opposite vector). This can be accomplished either by having a single generator produce the two sequential impulses of opposite vector or else by employing two mutually independent torsional impulse generators, each of which acts at the proper time to produce only one of the two successive torsional impulses with opposite vector.

The torsional impulse generator(s) may be disposed in or on the stock (as defined supra) or the recoilable system of the sporting weapon, or between these two units. Preferably they are disposed in the recoilable system or between the recoil system and the stock. As a result, the torsional impulses which they produce can act directly on the primary torsional impulse of the recoil system at the location at which the latter impulse arises. This affords the advantage that the bearings or supports are not stressed with additional forces resulting from the torques. The lower the forces on the bearings of the recoil system, the lower the friction forces accompanying the firing and thus the lower the undesirable reactive forces acting on the stock or grip of the weapon.

One or more torsional impulse generators may be used for compensating the torsional impulse or alternating torsional impulses induced by the recoil system. If there is more than one generator they act in mutually complementary fashion and may be in pairs to respond to alternating torsional impulses. Since torsional impulses, like torques, are planar, i.e. they can be represented by free vectors, they can be shifted in their respective planes of action or in planes parallel to these without substantial (fundamental) changes in their action. Consequently, a resultant torsional impulse is formed from the vector sum of the individual torsional impulses of the different torsional impulse generators.

According to the invention, torsional impulse generators which are disposed between the recoil system and the stock or grip comprise mechanisms which exert oppositely directed forces on these respective parts during the firing phase. The line of action of the force on the recoil system passes relatively far from the center of mass of said system, while it is preferred that the line of action of the force on the stock or grip passes close to or through the center of mass of said stock or grip.

For the mechanism to interact with the recoilable system to produce a torsional impulse which is oppositely directed to the torsional impulse induced in the system upon firing, the following basic conditions must be satisfied. The general direction of the force imposed on the system by the mechanism must coincide with the direction of the impulse induced in the system by the firing, if the center of mass of the system lies between the line of action of the induced (linear) impulse and that of the imposed force. However, if the center of mass of the recoil system lies on the same side of the line of action of the imposed force and that of the induced impulse, the directions of the impulse and force must be opposite.

The force which is exerted by the generating mechanism on the stock or grip during the firing phase is the reaction force to the force of the generating mechanism acting on the recoil system. Thus, it has the same magnitude but opposite direction. The line of action of this reaction force should be as close as possible to the center of mass of the stock or grip, so that these parts do not suffer torsional impulse as a result of the action of the force, in addition to suffering the unavoidable linear impulse.

However, if it cannot be arranged for the line of action of the above-mentioned force to pass in the vicinity of or through the center of mass of the stock or grip, it should at least be arranged for the torsional impulse which is generated to have the same sign as the torsional impulse of the generating mechanism acting on the recoil system. As a result, the two torsional impulses will add up to a greater magnitude and not be reduced. Transmission from the stock or grip to the recoil system occurs through the system bearing or support. Naturally, in such a case it is most desirable that to the extent possible the overall resultant torsional impulses add up to zero.

The mechanism which generates a torsional impulse on the recoil system and/or the stock or grip during the firing phase may have various embodiments. For a purely mechanical embodiment, it is proposed to realize the mechanism in the form of a driven cam transmission, operating by the inclined plane principle. The cam linkage comprised herein is a longitudinally profiled control surface rod, said profiling being in the form of from one to several surface segments of different slope, whereby cam follower levers in the form of dogs follow one or more of the different profiled levels in relative motion. The drive comprises at least one spring to press the dog (or dogs) and the control surface rod together in the region of the surface segments of the latter which are inclined to its longitudinal direction. The control surface rod is fixed with its longitudinal direction the same (or nearly the same) as the translation direction of the recoil system. Said fixing is either to the recoil system or to the stock or grip. If the rod is fixed to the recoil system, the dogs are fixed to the stock or grip, and vice versa. If there are multiple dogs, it may be useful also to provide multiple longitudinal sides on the control-surface rod, which sides are profiled symmetrically or asymmetrically with respect to each other.

In order to be able to compensate for the torsional impulse induced in the recoil system during the firing phase by a counter torsional impulse produced by the force of the generating mechanism, the parameters which determine that force must be set while taking into account their interaction. In the process, it may be necessary to use surface segments of positive and negative slope as well as zero slope in the profiled longitudinal sides of the control surface rod.

A generating mechanism operating according to a different principle makes use of the electromagnetic force of an electromagnet with moving armature, which electromagnet is powered from an electric current source through a switch. The electromagnet and armature, respectively, are alternatively attached to the system or to the stock or grip. If instead of a nonmagnetic armature one uses a so-called poled permanent magnet armature for the electromagnets, then the direction of the force changes if the current direction is reversed.

In another generating mechanism the repulsion force of two magnetic poles of like type is made use of, according to the principle of Elihu Thompson. This mechanism comprises a ferromagnetic rod on one end of which a coil is attached which is powered from an electric current source through a switch. A metal ring is slid over the other end, which ring is loose and is axially moveable. The ferromagnetic rod with the coil, on the one hand, and the metal ring, on the other, are attached to the recoil system and the stock or grip, respectively, or vice versa. If one passes an electric current through the coil, a magnetic field is established which during the time period of its variation induces a strong electric secondary current in the opposite direction in the metal ring. The self-consistent field of the ring is of opposite polarity from the primary magnetic field of the coil, whereby the two magnetic fields and their underlying parts (of the device) strongly repel each other. If the repulsion force only needs to last for a short time, the coil may be supplied with direct current. Otherwise, alternating current must be used. The metal ring is preferably made of copper or aluminum. As a replacement of approximately equal value for the metal ring, one may use a coil of a very few windings of a thick wire, electrically short-circuited.

With another type of torsional impulse generator, the torsional impulse needed for compensation is obtained by the rotational acceleration and/or rotational deceleration of an added, rotatably mounted mass. Such a torsional impulse generator is comprised, for example, by a flywheel driven by a quick-starting motor, whereby the flywheel can be rotated within the very short interval during which the torsional impulse of the recoil system, which impulse is to be compensated, originates. In this, it is irrelevant whether immediately prior to this instant the flywheel is still at rest or is already rotating (uniformly).

One may also produce a torsional impulse by using a device to decelerate a flywheel which has been previously set into rotation by a motor. In this way, without extraordinary capital expense, one may generate even a relatively large torsional impulse in a short time; and this is an advantage over the acceleration method.

Of course, the rotational acceleration and braking methods may be combined. One may employ this combination if the torsional impulse generator needs to produce an alternating torsional impulse due to the fact that the torsional impulse to be compensated reduces its direction during the firing phase. It has been pointed out supra, in this connection, that the torsional impulses of the recoil system and of the torsional impulse generator must be continuously oppositely directed and equal in magnitude.

As the motor which will drive the rotatably mounted mass, an electric motor is proposed, powered by a current source, through a switch. Its rotor comprises part, or in some cases the entirety, of the rotatable mass. Accordingly, the stator of the motor must be rotationally rigidly connected to the part of the weapon on which the torsional impulse is to act.

If the torsional impulse in question is to be produced by deceleration of a previously set in motion motor-rotor or flywheel rather than by rotational acceleration of it, a controllable brake is needed, in addition to a motor. This brake may be, for example, an electromagnetically actuated friction brake, controllable by an electrical switch. Another advantageous possibility for braking involves converting the electric motor into a generator by electrically reversing its windings, and dissipating the electrical braking work into a load resistor.

Additionally, in the case of torsional impulse generators based on the rotational acceleration principle, deceleration of the rotating mass is required after the transfer of the torsional impulse in order to start a new operating cycle. This decleration may proceed smoothly and gently, so that the user does not notice, or hardly notices, the deceleration torsional impulse, which extends over a relatively long interval. The braking means may be the same as described in the preceding paragraph. In the simplest case, it may be provided that the bearing of the rotatable mass has a moderate amount of friction, so that the rotational motion comes to a stop on its own. Alternatively, electrical eddy current braking could be provided, which also is relatively trouble-free.

The electrical control switches, mentioned supra in various contexts, for controlling the torsional impulse generators must be actuated at precisely defined instants at the start of and possibly also during the firing phase. They may be, for example, mechanical or photoelectric switches, or electronic switches which react to change in a field parameter. As much as possible they are mounted on or near parts of the weapon which are moved in a predetermined manner at the triggering of the shot or during firing and which parts can supply a switching signal. The firing or trigger mechanism is particularly suited for this because it contains parts which mark the start of the firing phase by means of a definite relative position.

For the timewise determination of the torsional impulse to be produced by the torsional impulse generator, it can be important that the switch is also switched back off during the firing phase, or that the switching off is accomplished by a second switch. Also, an electronic device is conceivable, whereby the electrical energy for the torsional impulse generator or generators is controlled via a well-defined program.

DETAILED DESCRIPTION OF THE DRAWINGS

List of Figure Labels:

| | |
|---|---|
| 1 | stock (gunstock) |
| 2 | recoilable (recoil) system |
| 3 | basic piece of stock |
| 4 | cover sleeve (case bushing) |
| 5 | trigger guard |
| 6 | sight |
| 7 | breech casing |
| 8 | barrel |
| 9 | firing mechanism |
| 10 | trigger |
| 11 | compression cylinder |
| 12 | compression piston |
| 13 | piston rod |
| 14 | compression spring |
| 15 | cocking mechanism |
| 16 | projectile |
| 17 | mechanism (torsional impulse generator) |
| 18 | abutment |
| 19 | control surface rod |
| 20, 21 | dogs (cam follower levers) |
| 22, 23 | cylindrical pins |
| 24, 25 | tension springs |
| 26, 27 | cylindrical pins |
| 28, 29 | rollers |
| 30 | flattened part (truncation) |
| 31–36 | devices (torsional impulse generators) |
| 37 | rod (ferromagnetic) |

-continued

| | |
|---|---|
| 38 | coil |
| 39 | metal ring |
| 40 | holder, tube-shaped |
| 41 | switch |
| 42 | electric current source |
| 43 | storage battery |
| 44 | storage capacitor |
| 45 | can |
| 46 | coil |
| 47 | holder |
| 48 | armature |
| 49 | head |
| 50 | mass |
| 51 | electric motor |
| 52 | cavity |
| 53 | switch |

Broadly, the recoilless air rifle shown comprises a stock 1 and a recoil system 2. These two main parts are assembled from multiple respective sub-parts, and may be moved back and forth relative to each other along the longitudinal axis of the rifle, over an extent which is limited on both sides (i.e., is limited for each of the two main parts, respectively). No relative linear or rotatable motions are possible on any other axes or in any other directions.

The construction of stock 1 comprises basic piece 3, a cover sleeve (or case bushing) 4, and the trigger guard 5. Additionally, a sight 6 is attached in the top rear area of cover sleeve 4. The recoil system 2, which is slidably mounted in cover sleeve 4, comprises, among other things, a breech casing 7, a barrel 8, and a firing mechanism 9 with trigger 10. In the interior of the breech casing there is a back-and-forth slidable compression cylinder 11, and in said cylinder in turn there is an axially back-and-forth moveable compression piston 12 with piston rod 13. Compression piston 12 is acted on by a compression spring 14 in the firing direction, i.e., toward barrel 8. Cover sleeve 4, breech casing 7, barrel 8, and also compression cylinder 11, compression piston 12, piston rod 13, and compression spring 14 have a common major axis and are interconnectedly configured up to the barrel.

A cocking mechanism 15, comprising levers, is pivotably attached to breech casing 7 and compression cylinder 11. It extends outward through slot openings in breech casing 7 and cover sleeve 4. Cocking mechanism 15 in its rest position is basicall parallel to the longitudinal axis of the rifle.

Figure 2:
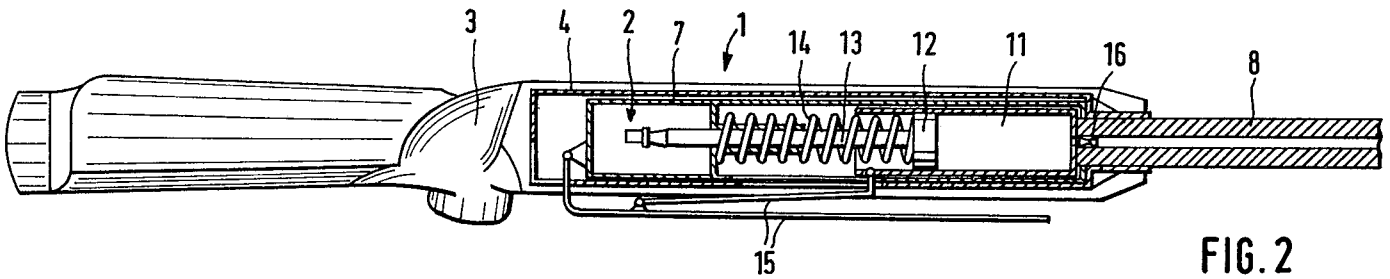
FIG. 2 shows a top view, with partial cutaway, of the air rifle of FIG. 1.

For compressing the compression spring 14 and to prepare the rifle for firing, compression cylinder 11 along with compression piston 12 which presses against the forward (barrelward) end face of said cylinder is moved backward by the cocking mechanism 15 in the direction opposite the firing direction, in known fashion. In about the final third of the cocking stroke, the cocking mechanism 15 comes into contact with a stop face on cover sleeve 4, and this brings about the sliding of recoil system 2 forward into its forward end position. At the conclusion of the cocking stroke a catch (not shown) in the firing mechanism 9 engages a notch in the free end of piston rod 13 and prevents back travel of the latter. The rear opening of the barrel is now free (the piston having been pulled backward away from it) and the chamber can be loaded with the projectile 16. When the cocking mechanism 15 is subsequently moved back to its initial position, compression piston 12 stays in its rearward, cocked position, while compression cylinder 11 is slid forward by cocking mechanism 15, and returns to its initial forward position. FIG. 2 shows the state at this point. The air rifle is now ready to fire.

The air rifle is equipped with a torsional impulse generator which is realized in various embodiments.

A first torsional impulse generator embodiment comprises a mechanism 17 (FIGS. 1, 3 and 4) with an exclusively mechanical mode of action, according to the principle of a cam transmission. It is mounted below recoil system 2 between the frontward (barrelward) end face of the firing mechanism 9 and an abutment 18 attached to the cover sleeve 4. In particular, this mechanism 17 comprises: a control surface rod 19 which is rigidly connected to the firing mechanism 9 and extends in parallel with the longitudinal axis of the recoil system; two lever like dogs 20 and 21, disposed symmetrically with respect to rod 19 and swingably mounted at one end on cylindrical pivots 22 and 23, respectively, which pivots run approximately vertically in the normal use position of the air rifle—the said mounting being on abutment 18; and a pair of tension springs 24 and 25 to press the free ends of the dogs against control surface rod 19.

Figure 3:
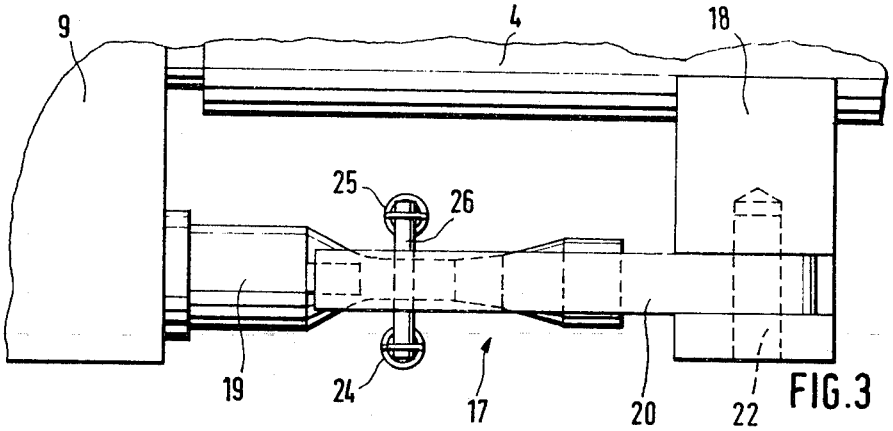
FIG. 3 shows an enlarged detail from FIG. 1, with a first embodiment of a torsional impulse generator.
Figure 4:
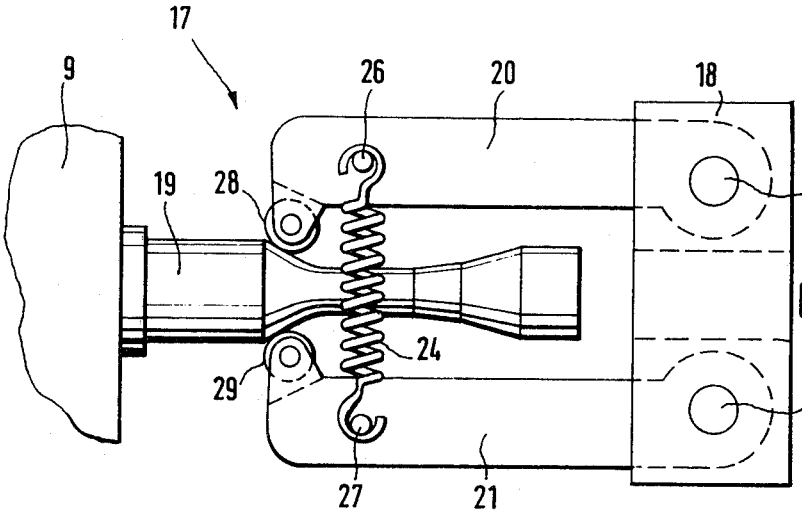
FIG. 4 shows a bottom view of the torsional impulse generator of FIG. 3.

The two dogs 20 and 21 are in the center plane of control surface rod 19, which plane is approximately horizontal in the normal use position of the air rifle, and are swingable toward or away from rod 19 in this plane. Cylindrical pins 26 and 27 are fit into the free moving ends of the dogs, for attaching tension springs 24 and 25; these pins run perpendicularly to the plane of movement of the respective dog, and are connected in pairs by the tension springs 24 and 25, respectively, which run parallel to the said center plane, under and over it, perpendicularly to the firing direction, as shown in FIGS. 3 and 4. The same said ends of the dogs each have a rotatably mounted roller (28 and 29) which presses against the surface of control surface rod 19.

Control surface rod 19 is a body of rotation with cylindrical and tapered surface segments of varying length, diameter, slope, and direction of slope. In addition, one surface segment has the shape of a paraboloid of rotation. The transistions between the individual successive surface segments are without discontinuities in diameter. Thus, control surface rod 19 has a longitudinal contour in the form of a polygonal path, which is at least as long as the recoil motion of recoil system 2 with respect to stock 1 caused by the firing. The exact course of the longitudinal contour of control surface rod 19, in this example, and the orientation, form, diameter progression and length of the individual segments can be seen from FIG. 4.

As already mentioned, the two dogs 20 and 21 are supported by their end-disposed rollers 28 and 29 against the profiled surface of control surface rod 19. If the given active surface segment is sloped in the firing (i.e., longitudinal) direction, force components against control surface rod 19 arise which have their lines of action parallel to the major axis of said rod. The signs of these force components are determined by the slope direction of the given surface segments. The magnitudes are proportional to the slope and to the magnitude of the radially directed pressing force.

The axial forces produced in this manner from control surface rod 19 act on the recoil system 2 at a certain distance from its center of mass S (FIG. 1), and thus produce a torque on it. In the firing phase, the recoil system 2 is being moved in the axial direction, the dynamic effect of the torque acting for a short time interval is a torsional impulse. This torsional impulse is in equilibrium with the primary torsional impulse induced in system 2 during the firing, i.e., it is simultaneous with it and has the same magnitude and opposite direction. Since the center of mass S of system 2 lies between the longitudinal axis of the control surface rod 19 and the common longitudinal axis of compression piston 12, piston rod 13, and compression spring 14, conditions are established for the direction of the force on control surface rod 19 to coincide at each instant of the firing phase with the direction of the linear force impulse induced in system 2. Accordingly, the slope directions of the segments of the control surface rod are first negative in relation to the firing direction and then increasingly positive, in two stages following a cylindrical intermediate piece. The negative slope corresponds to reduction in the diameter of control surface rod 19, and the positive slope corresponds to increase in that diameter. Thus, in the initial part of the firing phase there is developed at control surface rod 19 a force which accelerates system 2 in the direction opposite the firing direction, and in the final part of the firing phase a decelerating force is developed. This force reversal is desired because with air powered weapons of the described type, there is an increasing retardation of the system recoil due to the gas force on the inner end face of compression cylinder 11, which gas force arises from the air compression, and this is accompanied by inversion of the torsional impulse. This development (i.e., torque vs. time) is in turn balanced in the torsional impulse generator.

The reaction force (or opposing force) of mechanism 17 is transmitted to cover sleeve 4 and thereby to stock 1, via dogs 20 and 21 and abutment 18. However, it can produce no torsional impulse on stock 1 because its line of action passes through the center of mass of the stock. Moreover, its linear impulse is so small in relation to the mass of stock 1, that the latter does not suffer substantail impact. Also, this opposing force reverses its direction in the course of the firing phase.

FIG. 4 shows mechanism 17 in the cocked weapon before the start of firing. Here dogs 20 and 21 with their rollers 28 and 29 rest on the first truncated conical segment of control surface rod 19, and they thereby produce continuous rolling forces. These forces would ordinarily cause recoil system 2 to slide a short distance in the direction opposite the firing direction, until rollers 28 and 29 run off said conical segment onto the central, cylindrical segment of profiled control surface rod 19. In order to prevent this prior to firing, an engageable and disengageable locking mechanism (not shown), which is itself known, is provided between stock 1 and recoil system 2, and this serves to lock the latter two parts in their ready-to-fire position relative to each other, prior to firing. The locking mechanism is controlled by firing mechanism 9, and it releases recoil system 2 at the precise instant firing is initiated. Thus, the locking and release occur automatically. This kind of locking is even necessary when no balancing torsional impulse generator is employed, and is indeed used even in the absence of such a generator, because the weapon may be held at an angle longitudinally, prior to firing, in which case the recoil system must not be allowed to slide back. Thus, there is nothing additional to deal with in connection with the locking mechanism when the invention is employed.

Figure 5:
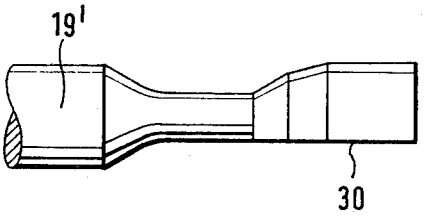
FIG. 5 shows another form of the control surface rod of FIG. 4.

FIG. 5 shows a control surface rod 19' having a different longitudinal profile from rod 19 but otherwise not differing from the latter. Particular attention is drawn to the fact that the profile of rod 19' is asymmetric, and thus rollers 28 and 29 follow different control curves. Rod 19' differs from rod 19 in the degree and sequence of the slopes of the conical end segments. Whereas with both rods the conical slopes to the right of the cylindrical middle segment increase outward gradually in stages, on rod 19' after a relatively steep conical segment, the roller 28 on dog 20 follows a flat profile.

The asymmetry of control surface rod 19' is created by flattening one side 30 of its free end. It has the purpose of limiting the deflection in this segment at the end of the firing phase to dog 20 alone. This imparts a sidewise impulse to the recoil system 2, which experience shows serves to dampen transverse vibrations of system 2.

Due to the complexity of the dynamic processes in firing and their interactions it is difficult to make precise qualitative let alone quantitative statements regarding them. While it is not too difficult to establish the general profile of control surface rods 19 and 19' based on accumulated knowledge, it is safer and quicker to develop the individual shape elements on rods 19 or 19' empirically.

Figure 6:
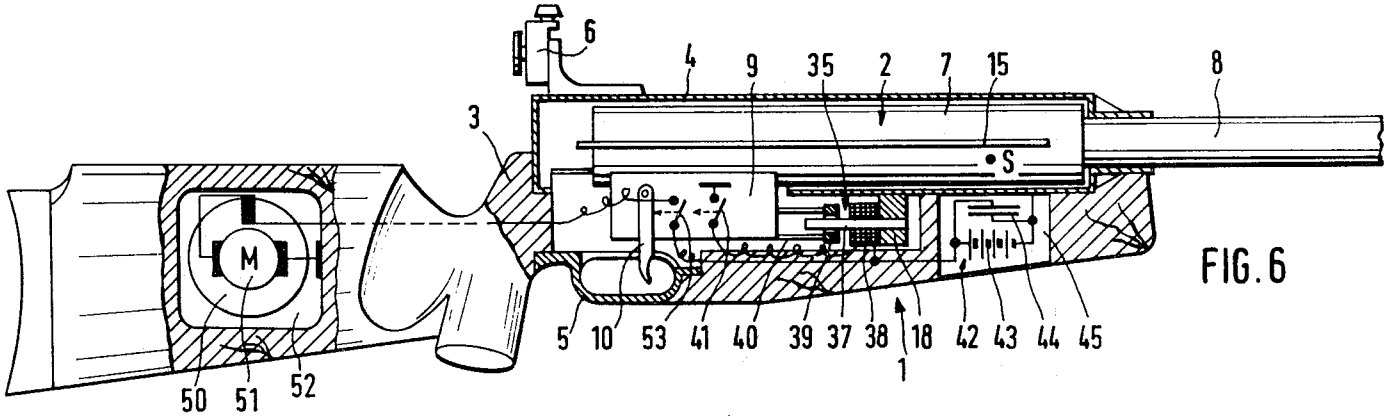
FIG. 6 shows the air rifle of FIG. 1 with two other embodiments of torsional impulse generators.
Figure 7:
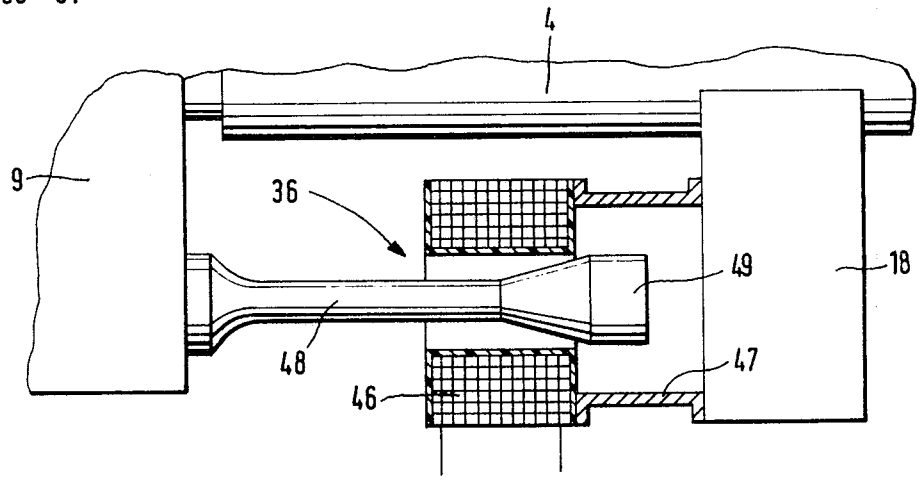
FIG. 7 shows a fourth embodiment of a torsional impulse generator.

FIGS. 6 and 7 show a total of three additional embodiments of torsional impulse generators in connection with an air rifle according to this invention. This air rifle is the same as that described supra in connection with and by FIGS. 1 and 2, with the exception of the features involving the torsional impulse generators.

Two of these embodiments of torsional impulse generators comprise devices 35 (FIG. 6) and 36 (FIG. 7), respectively, which operate by electromagnetic principles. Each is mounted under recoil system 2 between the barrel-side end face of firing mechanism 9 and abutment 18 which is attached to cover sleeve 4.

Device 35 is constructed as follows. A cylindrical ferromagnetic rod 37, made, for example, of soft iron, is affixed at its end to abutment 18; it runs parallel to the line of motion of recoil system 2 in the direction toward firing mechanism 9. The affixed end of rod 37 bears a concentrically disposed electric coil 38 which is firmly in contact with the end face of abutment 18 which faces the firing mechanism 9. A metal ring 39 having radial clearance is also attached concentrically to rod 37 (i.e., attached so as to have radial clearance); said attachment is to the end face of firing mechanism 9 which lies opposite to abutment 18, and is by means of a tubular holder 40. When system 2 is in its ready-to-fire position, representing its maximally forward displacement (in the firing direction) relative to stock 1, there is only a short axial distance between metal ring 39 and coil 38. Device 35 also comprises an electrical switch 41 which is controllable by firing mechanism 9 and is open when the weapon is ready to fire. Switch 41 is electrically connected (via conductors) to the electrical ground embodied in the directly linked metal parts of the air rifle, and to coil 38.

An electrical source 42 is provided for energizing device 35; it is also connected by conductors to the ground and to coil 38. It comprises a replaceable battery or storage battery 43 and a storage capacitor 44 connected in parallel with the latter. Of course, source 42 may contain other components known to one skilled in the art in this context, such as voltage dividers, free-running diodes to protect against back-induction voltages, and control and display devices. It is also possible to connect coil 38, switch 41, source 42, and the ground in a different order than that given here. If a specific return conductor (e.g., wire) is provided then the electrical ground comprising the metal parts does not, of course, have to be included in the circuit.

Source 42 is housed in chamber 45 which is closed to the outside and is formed by hollowing out material in the front part of the basic piece 35 of the stock.

Device 35 operates as follows: Simultaneously with the release of piston rod 13 by firing mechanism 9 at the start of firing, switch 41 is closed (also by mechanism 9). As a result, capacitor 44 discharges through coil 38. The rapidly developing strong magnetic field therein induces in metal ring 39 an electric current opposite to the current in the coil. The magnetic field of this induced current is of opposite polarity to that of coil 38, so that the corresponding poles of the two magnetic fields face each other, producing repulsion forces between coil 38 and metal ring 39. Thus, as in the previous discussion, axially directed forces are generated; and their effects are as described there.

Device 36, represented in FIG. 7, also forms an electromagnet, and comprises a ring-shaped electric coil 46 attached to the end face of abutment 18 which is turned toward firing mechanism 9, and also comprises rod armature 48, with which coil 46 is concentrically disposed. Armature 48 is attached to the end side of firing mechanism 9 which faces the abutment 18. On its end which is in the region of coil 46, armature 48 has a soft iron head 49 which is part cylindrical and part truncated conical, with diameter somewhat less than that of the coil, even in the head's cylindrical segment. In the ready-to-fire position of recoil system 2, around half the length of head 49 extends beyond coil 46 toward abutment 18.

Coil 46 is electrically connected to source 42 and switch 41 described supra with reference to FIG. 6, in the same manner as coil 38 of device 35. The circuit of switch 41 is closed at the instant of the start of firing when trigger 10 is pulled. The magnetic field of coil 46, through which coil current is now flowing, exerts a pulling force on head 49 of armature 48, which force acts in the direction opposite to the firing direction and produces a torsional impulse on recoil system 2.

Another torsional impulse generator of a completely different design is also shown, in addition to those designated as devices 17, 35 and 36. A schematic representation of it is given in FIG. 6. It involves a flywheel-like mass 50 mounted so as to be rotatable around its central axis and having an electric motor 51 in the form of a direct current series-wound motor with its rotor coupled to rotatable mass 50 and its stator affixed to basic piece 3 of the stock. The entire torsional impulse generator comprising parts 50 and 51 is disposed in a cavity 52 in the butt part of the basic piece 3 of the gunstock.

Electric motor 51 is connected by a first conductor to an electrical ground and by a second conductor, which includes a switch 53 to source 42. Switch 53 is directly controllable by trigger 10 and is kept open until immediately before the start of firing. As soon as the piston rod 13 which holds compression piston 12 is released from the catch (not shown) by the pulling of trigger 10, switch 53 closes the circuit, and electric motor 51 starts to drive rotatable mass 50 in accelerated rotation. The rotation direction is chosen such that the torsional impulse delivered by motor 51 to basic piece 3 of the gunstock is opposite to the torsional impulse induced by recoil system 2.

In order for the two torsional impulses to be in the same or parallel planes of action (as they should be), it is arranged for the plane of rotation of rotatable mass 50 to be parallel to the plane of the induced torsional impulse of the recoil system 2.

The power consumption and duration of powering of electric motor 51 (as of devices 35 and 36) are chosen such that the respective torsional impulses of the torsional impulse generator and the recoil system 2 at least approximately equilibrate. Accordingly, the two switches 41 and 53 are not always simple on-and-off switches as shown symbolically in FIG. 6. Depending on the need they may also comprise current direction-changers, additional switching functions, and power controller; i.e., they may amount to control devices. In particular, one may employ electronic controllers including microprocessors, to perform the above-described basic functions with regard to equilibrating the torsional impulses.

I claim:

1. In a sporting air gun in the nature of a recoilless pressurized-air weapon, said weapon including a gunstock with a barrel and firing mechanism mounted thereon, said weapon further having a recoilable system which is translatably mounted so as to slide forward and backward on the gunstock of the weapon in a direction which is generally longitudinal, and which recoilable system compensates by opposed motion the impulse from the firing of the weapon, said system minimally comprising a breech casing to which the barrel, the firing mechanism, and added masses are attachable to increase the weight of the system, and said system having a center of mass lying off the line of action of the impulse resulting from the firing, whereby a torsional impulse is superposed on said firing-resultant impulse;

the improvement comprising at least one torsional impulse generator positioned functionally with the weapon, which generator forms an autonomous functioning unit with other parts of the weapon, the torsional impulse resulting from said generator being simultaneous with and directed opposite to the torsional impulse which is induced by the recoilable system in the firing phase of operation, and said torsional impulse from the generator acting substantially in the same direction as said torsional impulse from the recoilable system;

wherein the torsional impulse generator is a device which produces a force which acts oppositely, respectively, on the recoilable system and the gunstock, the line of action of which force is relatively far from the center of mass of the system but close to the center of mass of the gunstock;

wherein the device is a driven cam transmission operating according to the principle of an inclined plane; and wherein the cam transmission is a longitudinally profiled control-surface rod, the profile of said rod being in the form of surface segments of different slope, whereby at least one cam follower lever in the form of a dog follows the different levels of the profile segments when the system and gunstock are in relative motion, and the drive of the cam transmission comprises at least one spring which presses the at least one dog against the control-surface rod in the region of the surface segments, which segments are sloped with respect to the longitudinal direction, the control-surface rod being affixed to one of the recoilable system and the gunstock, and the the dogs are affixed to the other of the gunstock and recoilable system.

2. A sporting air gun according to claim 1 wherein the control-surface rod has multiple longitudinal sides which are profiled symmetrically with respect to each other.

3. A sporting air gun according to claim 2 wherein the profiled longitudinal sides of the control-surface rod are comprised of surface segments with slopes varying from positive to negative.

4. A sporting air gun according to claim 1 wherein the control-surface rod has multiple longitudinal sides which are profiled asymmetrically with respect to each other.

5. A sporting air gun according to claim 1 wherein the center of mass of the system lies between the line of action of the linear impulse induced in the system by the firing and the line of action of the force of the device, and the general direction of the force imposed on the system by the device coincides with the direction of the induced linear impulse.

6. A sporting air gun according to claim 1 wherein the center of mass of the system lies outside the lines of action of the linear impulse induced in the system by the firing and of the force of the device, and the general direction of the force imposed on the system by the device is opposite to the direction of the induced linear impulse.

* * * * *